US006210227B1

(12) United States Patent
Yamasaki et al.

(10) Patent No.: US 6,210,227 B1
(45) Date of Patent: Apr. 3, 2001

(54) CONNECTOR AND METHOD OF SHIELDING SIGNAL TERMINAL

(75) Inventors: Shuji Yamasaki; Yoshihiro Kuroi, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/262,068

(22) Filed: Mar. 4, 1999

(30) Foreign Application Priority Data

Mar. 11, 1998 (JP) ..... 10-060045

(51) Int. Cl.[7] ..... H01R 13/648
(52) U.S. Cl. ..... 439/608
(58) Field of Search ..... 439/608, 108, 439/607, 79

(56) References Cited

U.S. PATENT DOCUMENTS 5,460,533 * 10/1995 Broeksteeg ..... 439/101
5,660,551 * 8/1997 Sakurai ..... 439/108

* cited by examiner

*Primary Examiner*—Khiem Nguyen
(74) *Attorney, Agent, or Firm*—Young & Thompson

(57) ABSTRACT

In order to prevent problems such as crosstalk generated in a connector for connecting en bloc a plurality of signal terminals, there is provided a new connector. In this connector, a plurality of ground terminals are disposed so as to surround the signal terminals and the ground terminal is provided with a plate-type sealed beam 8*a* extending toward the connecting top end, a main beam formed in the crossing direction to the sealed beam, and a sub-beam. Since the ground terminals are F-shaped and since the ground terminal is provided with a sealed beam, the electromagnetic waves emitted from the signal terminal can be effectively shielded.

6 Claims, 9 Drawing Sheets

10
3b
5
6
7
8b
9

CONNECTOR AND METHOD OF SHIELDING SIGNAL TERMINAL

BACKGROUND OF THE INVENTION

1. Field of the Invention

The present invention relates to a connector and particularly relates to a connector comprising a plurality of signal terminals for transmitting electric signals and a plurality of ground terminals disposed so as to surround the signal terminals and both the signal and ground terminals are arranged in a zigzag manner, and to a method of shielding the signal terminals.

The present application is based on Patent Application No. Hei 10-060045 filed in Japan, the contents of which are incorporated herein by reference.

2. Background Art

Conventionally, connectors for mutually connecting bases for transferring high frequency signals or for mutually connecting bases and cables are constructed with a plurality of signal terminals and the ground terminals. In general, those ground terminals are normally disposed around the signal terminals to form a pseudo coaxial structure. Such a structure is advantageous in improving the transmission properties of the high frequency signal and in suppressing crosstalk.

FIG. 9 shows a perspective view of a terminal 20 used for the above mentioned connector, and it is general to commonly use this terminal 20 for the signal terminals as well as for ground terminals.

However, in a connector having such a simple terminal, such as the terminal shown in FIG. 9, if the signal frequency passing the connector becomes high, the amount of electromagnetic radiation emitted from the signal terminals increases, which results in causing crosstalk in adjacent signal terminals.

In contrast, the connector, proposed in the Japanese Patent Application, First Publication No. Hei 7-211404 is provided with a ground terminal with a modified shape, which shields electromagnetic waves emitted from each signal terminal, in order to suppress generation of crosstalk. In this case, however, the shape of the ground terminals is modified so as to be able to shield the electromagnetic waves emitted from the signal terminals for eliminating the generation of crosstalk. However, in this ground terminal, only the shape for connecting it with the base is modified, and the structure inside the connector (inside the housing) remains simple. Thus, since the electromagnetic radiation still passes through a tulip like open portion, sufficient shielding of radiation and sufficient removal of crosstalk is not realized by that connector. It is also difficult from the manufacturing point of view to form the portion bent at an right angle to the base connecting side so as to be able to effectively shield the radiation.

It is therefore the object of the present invention to provide a connector with a simple structure and also provide a method for shielding the signal terminals so as to shield the electromagnetic radiation even in inside of the connector to ensure prevention of problems such as crosstalk.

SUMMARY OF THE INVENTION

According to the first aspect of the present invention, the present invention provides a connector comprising a plurality of signal terminals for transmitting electric signals and a plurality of ground terminals for grounding disposed so as to surround the signal terminals and both signal terminals and ground terminals being arranged in a zigzag manner, wherein said ground terminals are provided with a plate-like sealed beam projecting in the direction of the front end of the connected portion; a sub-beam formed bent at right angle from the base position of said sealed beam towards its point and extending in parallel with said sealed beam without interfering with said sealed beam; and a main beam extending in parallel with said sealed beam and bent at an right angle in the same direction as the sub-beam, such that the shape of the connector is F-shaped, when viewed from the direction of connecting portion.

According to the present aspect of the invention, the plate-like sealed beam shields the electromagnetic radiation such that it is possible to prevent crosstalk . The formation of the sealed beam makes it possible to sufficiently shield the inside of the connector.

According to the second aspect of the present invention, the connector according to the first aspect has a sealed beam which is L-shaped.

This connector provides a shield effect between the signal terminals by a plate or a L-shaped sealed beam, so that problems such as crosstalk can be eliminated.

In addition, the L-shaped sealed beam means that the sealed beam is provided with a flange extending vertically from one end of the plate-like sealed beam, so that it is possible to shield the electromagnetic radiation from the perpendicular and the lateral directions by means of the plate section and the flange section which is vertical to the plate section.

According to the third aspect of the present invention, the connector according to the first aspect can be more surely shielded when adopting a constitution such that the circumference of the signal terminals are surrounded by the ground terminals and the ground pins of the part to be connected to (called hereinafter "counterpart connector").

According to the fourth aspect, it is more preferable to adopt a structure in which the ground terminals and the ground pins of the counterpart connector cross at a right angle.

According to the fifth aspect of the present invention, the present invention provide a connector comprising a plurality of signal terminals for transmitting electric signals and a plurality of ground terminals disposed so as to surround the signal terminals, and both signal terminals and ground terminals being arranged in a zigzag manner, wherein, when connecting, the radiation from the signal terminals is shielded by using a design such that the circumference of the signal terminals are surrounded by the ground terminals and the ground pins of the counterpart connector.

According to this shielding method, the connector is designed so as to shield the signal terminals only at the time of connection, and it is not necessary to shield the radiation before the connection so that the connector may have an improved structure with a higher degree of structural freedom.

In addition, in this aspect of the invention, it is more preferable to adopt a structure in which the ground terminals and the ground pins of the counterpart connector cross at a right angle, as described in the sixth aspect of the present invention.

BRIEF DESCRIPTION OF DRAWINGS

FIG. 3A is a front view, 3B is a plan view, and 3C is a rear view from the terminal side of the base connecting side, and 3D is a perspective view from the base connecting side.

FIG. 6A is a front view, 6B is a plan view, 6C is a rear view from the terminal side of the base connecting side, and 6D is a perspective view from the base connecting side.

DETAILED DESCRIPTION OF THE PREFERRED EMBODIMENTS

Figure 1:
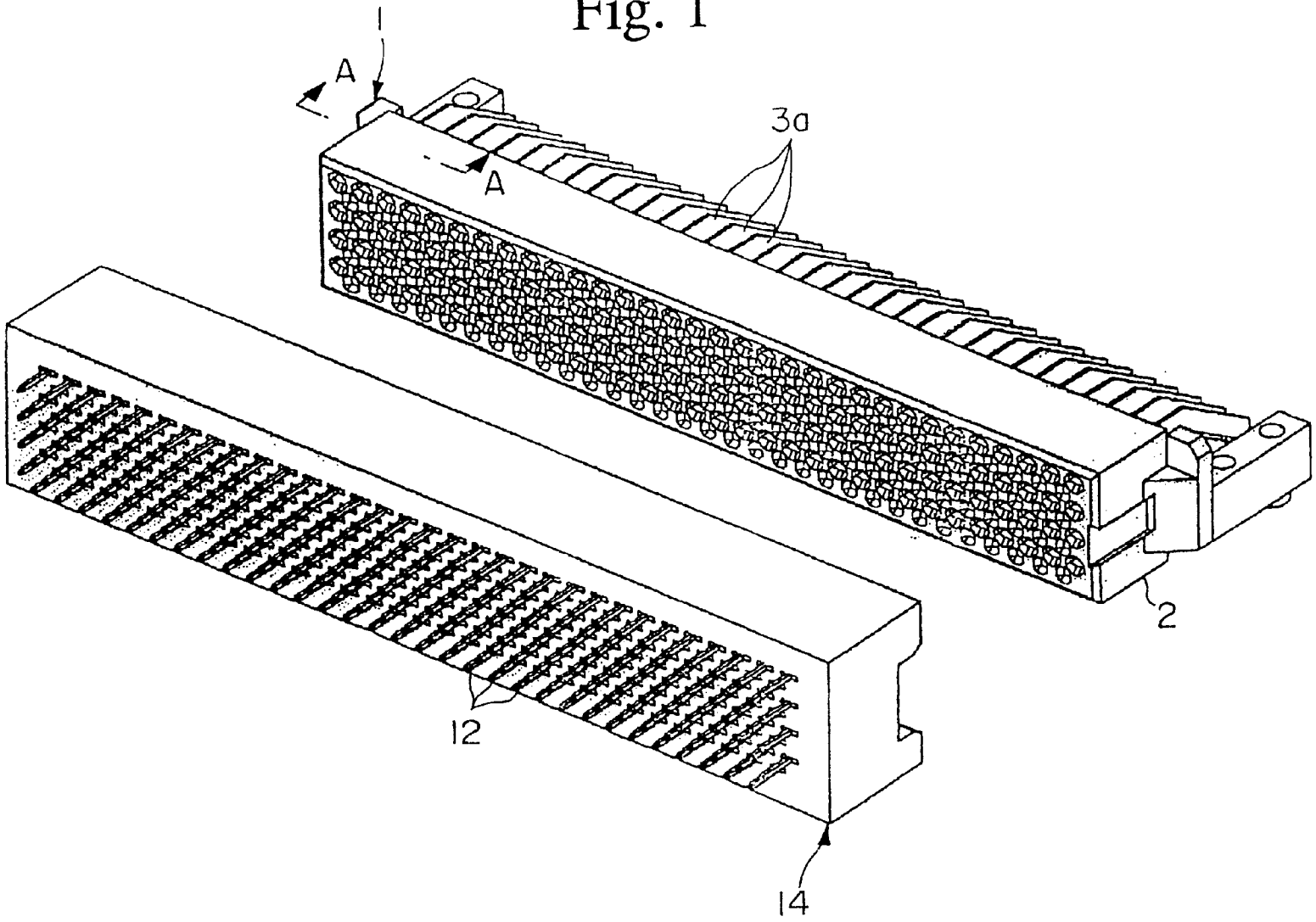
FIG. 1 is a perspective view showing the female type connector according to the first embodiment of the present invention.
Figure 8:
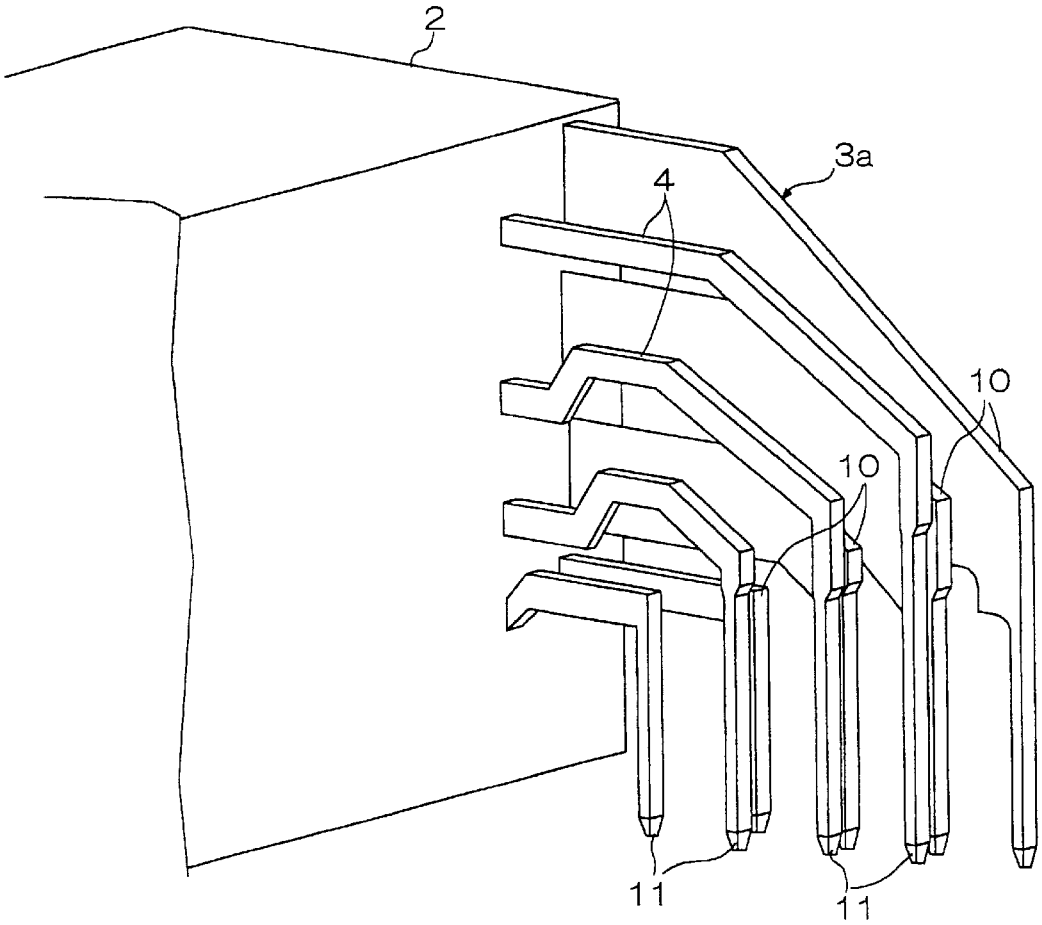
FIG. 8 is a perspective view of terminal section of the ground terminals at the base connecting side which is applied to the female type connector according to the first and second embodiments of the present invention.
Figure 9:
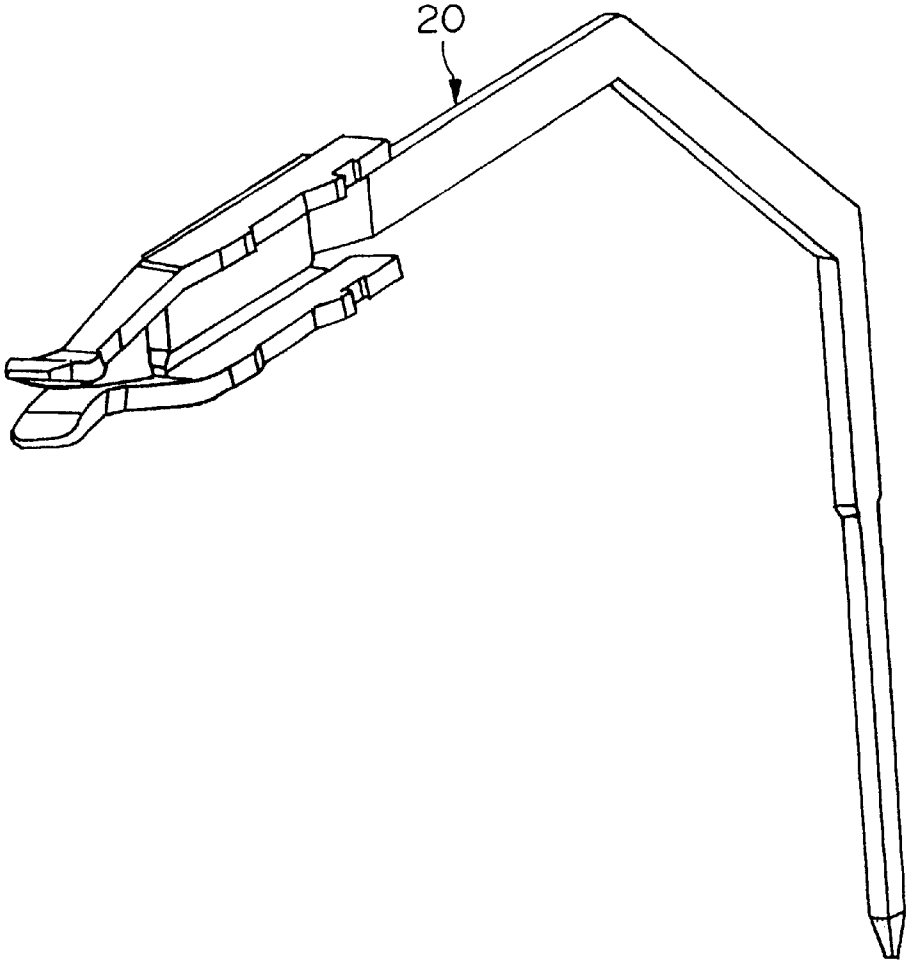
Fig. 9 (PRIOR ART)
FIG. 9 is a perspective view of a ground terminal applied to the conventional connector.

Hereinafter, the first embodiment of the present invention will be described with reference to FIGS. 1 to 4 and FIG. 8. The connector according to this embodiment is represented by a female type connector with the reference numeral 1, which is shown in FIG. 1 and FIG. 8. This female type connector is hereinafter explained.

Figure 4:
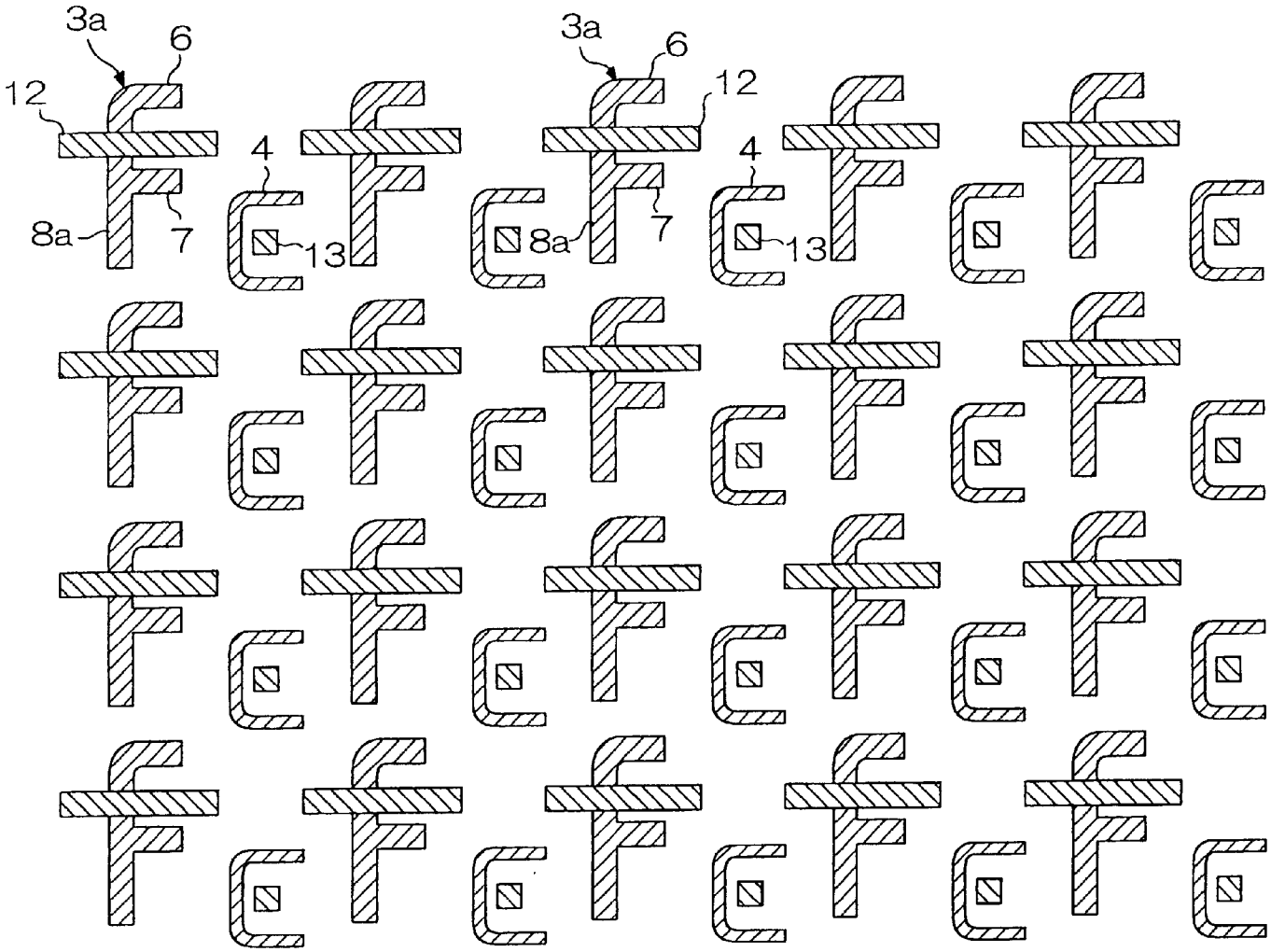
FIG. 4 is a cross sectional view along A—A line of FIG. 1, when the male type connectors are inserted.

As shown in FIG. 1 and FIG. 8, a plurality of signal terminals 4 and a plurality of ground terminals 3*a* are press fit and held in the housing of the female type connector 1. As shown in FIG. 4, these terminals 4 and 3*a* are arranged in a zigzag manner wherein the ground terminals 3*a* are located on the diagonal lines diagonally connecting signal terminals 4 a plurality of which are arranged lengthwise and crosswise and the signal terminals 4 are disposed in coaxial-like structure in which the signal terminals are surrounded on all sides by the ground terminals 3*a*.

Figure 2:
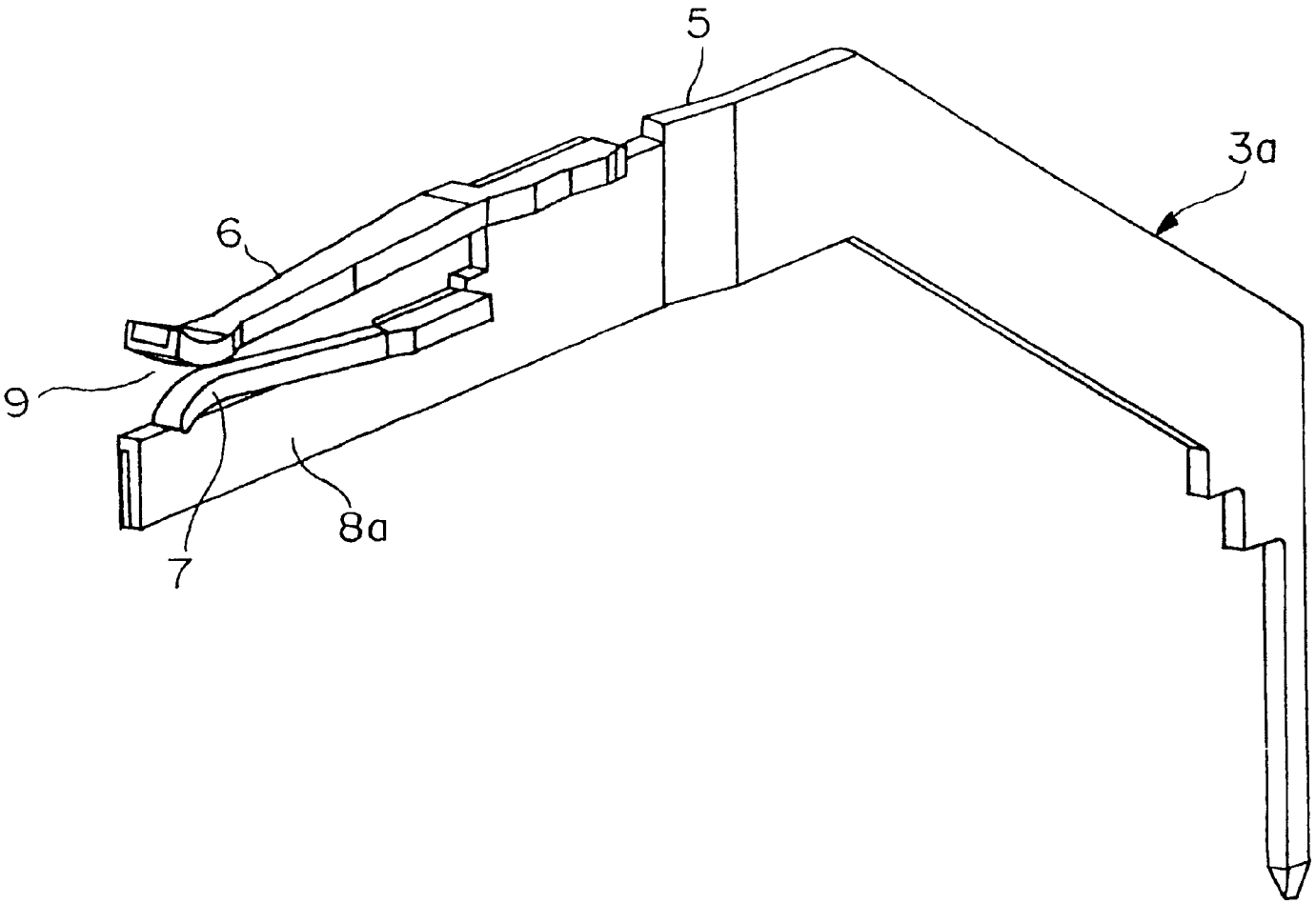
FIG. 2 is a diagram showing a ground terminal applied to the connector shown in FIG. 1, and showing a perspective view from the connecting point of the connector.
Figure 3D:
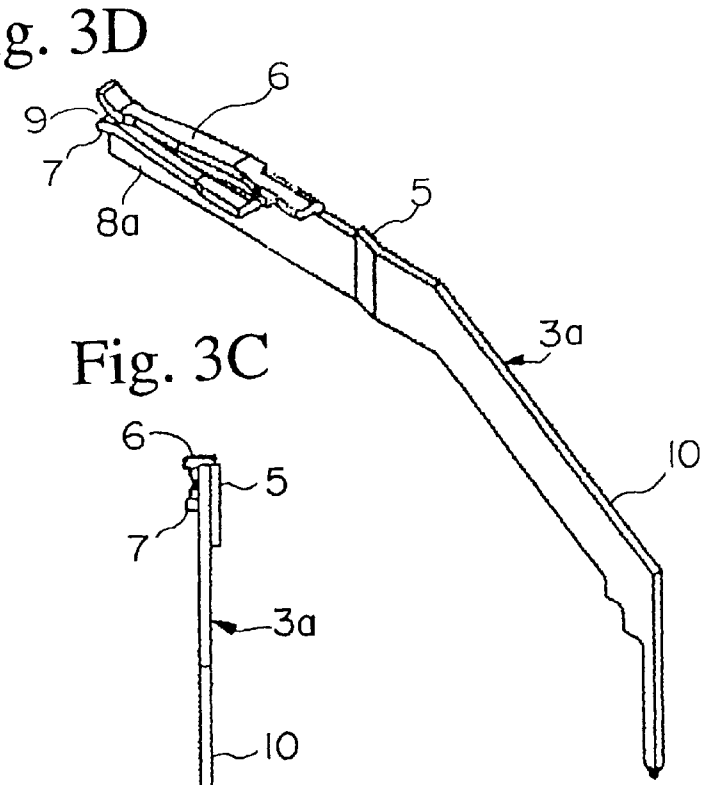
FIGS. 3A, 3B, 3C and 3D are diagrams showing a ground terminal applied to the connector shown in FIG. 1.
Figure 3C:
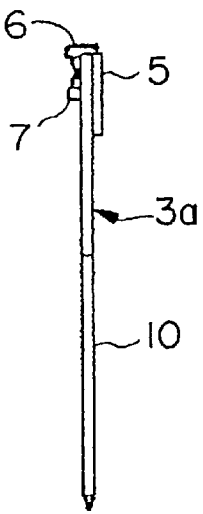
Figure 3B:
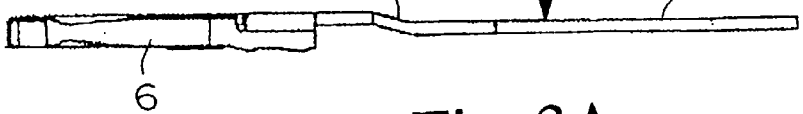
Figure 3A:
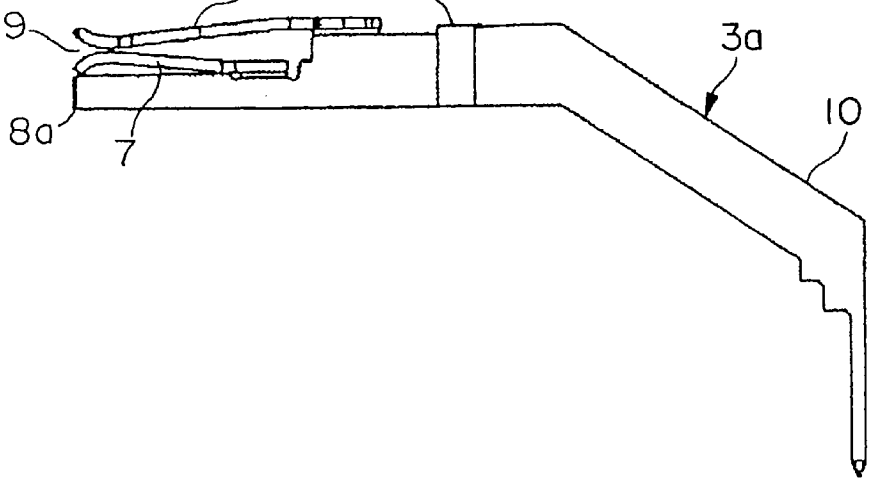

FIGS. 2 and 3 are diagrams showing the ground terminals. FIG. 2 is a perspective view of the ground terminal viewing from the direction of the connecting portion (from the tulip type contact 9). FIG. 3 also shows the ground terminal and FIG. 3A is a front view, 3B is a plan view, 3C is a rear view viewing from the connecting portion 10 with the base, and 3D is a perspective view from the connecting portion with the base.

As shown in FIGS. 2, 3A, 3B, 3C and 3D,the ground terminals 3*a* are formed by first punching conductive metal plates such as copper alloys and the main beam 6 is then formed so as to extend to the connecting portion of the connector by bending at a right angle a portion of the edge corresponding to the proximal end 5 of the contact of the thus punch formed metal plate. Adjacent to the main beam 6, a sealed beam 8*a,* formed by a broad plate and extending to the connecting portion of the connector, is provided without being subjected to bending in parallel with the contact proximal end 5. Therefore, both the main beam 6 and the sealed beam 8*a* are formed which extending in parallel from the contact proximal end 5 to the connecting portion of the connector.

Furthermore, a sub-beam 7, the top end portion of which is bent at an right angle, is formed from the middlepoint of the extending direction of the sealed beam 8*a,* so that, when viewing the ground terminal 3*a* from the connecting portion or from the back side (refer FIG. 2 and FIG. 3C), the ground terminal is F-shaped. As shown in FIG. 2, the sub-beam 7 extends to the top of the connecting portion independent of the sealed beam 8 without these beams interfering with each other. Accordingly, in this female-type connector 1, the main beam 6, the sealed beam 8*a,* and the sub-beam 7 extend from the contact proximal end 5 to the top end of the connector in parallel each other.

As shown in FIG. 8, the terminal portion 10 for connecting with the base is formed by a broad plate so as to be able to sufficiently shield the side surface of terminal portion 11 of the signal terminals 4.

As shown in FIG. 1, the female type connectors 1 are used by mounting on the base of the package board side which is not shown in the connecting state with the male-type connectors mounted on the base of the mother board side. At this time, as shown in FIG. 4, each signal terminals 4 of the female-type connector 1 is connected with a signal pin 13 in the male-type connector, and each ground terminal 3*a* is connected with a ground pin 12 in the male-type connector 14. In addition, these ground pins 12 are formed in a broad and flat shape, such that, when connected with the female-type connector, the ground pins 12 and the ground terminals 3*a* are disposed to surround the signal pins 12 and the signal terminals 4. When a high frequency signal is transmitted through in the signal terminals in the connecting state, the signal terminals emit electromagnetic waves. The higher the frequency of the high frequency signal, the higher the emission of the electromagnetic waves. An electromotive force is generated when the emitted electromagnetic waves impinges on the neighboring signal terminals, which results in causing cross-talk noise. However, when the connector of the present invention is used, the ground terminals 3*a* play the role of shielding the electromagnetic waves to prevent the generation of cross-talk noise.

That is, as shown in FIGS. 2 and 3, the ground terminals 3*a* are provided with a sealed beam 8*a* extending to the top end of the connector, and this sealed beam plays in role in shielding horizontally the electromagnetic waves emitted from the signal terminals. In addition, as shown in FIG. 4, since the ground pin 12 of the male-type connector 14 is flat and is located so as to cross at a right angle with the sealed beam 8*a* of the ground terminal 3*a,* the ground pin 12, when connected, shields the electromagnetic waves in the vertical direction (this relates to the concept of shielding the signal terminal as recited in the claims). Here, since the ground pin 12 also contributes to the shielding of the electromagnetic waves, it is not necessary to enlarge the size of the sealed beam 8*a* in order to shield the electromagnetic waves sufficiently, so that the freedom of designing for designing the female-type connector 1 increases and also lightening of the connector becomes possible.

Furthermore, since the sub-beam 7 facing to the main beam 6 does not extend from the end of the contact proximal end 5, but extends from the middlepoint of the sealed beams and since the sub-beam 7 is formed inside between the main beam 6 and the sealed beam 8*a,* the space of the connecting end of the connector is small so that the electromagnetic waves are effectively shielded.

The female-type connector according to one embodiment of the present invention comprises a plate-type sealed beam 8*a* of the ground terminal 3*a* which is disposed diagonally and adjacent to the signal terminal and the ground terminals 3*a* and the signal terminals 4 are arranged in a zigzag manner, so that the ground terminals 3*a* located surrounding the signal terminals 4 shield the electromagnetic waves emitted from the signal terminals 4 at the position of the ground terminals 3*a*. In particular, the wide sealed beam 8*a* provided for this ground terminal 3*a* is effective to shield the horizontal broadening of the electromagnetic waves. Consequently, crosstalk generated between signal terminals 4 can be effectively reduced, and it is possible to impose the transmission characteristics of the high frequency signals.

Since the sub-beam is formed from the middle of the sealed beam 8*a,* and formed inside of the ground terminals 3*a* (formed in between the main beam 6 and the sealed beam 8*a*), the amount of materials for forming the connector becomes small so that it is possible to reduce the cost of the connector.

The second embodiment of the present invention is described hereinafter. The connector according to this embodiment comprises, as shown in FIG. 7, signal terminals 4 and ground terminals 3*a* and 3*b* arranged alternately and the number of rows of those terminals are made to be an even number.

Figure 7:
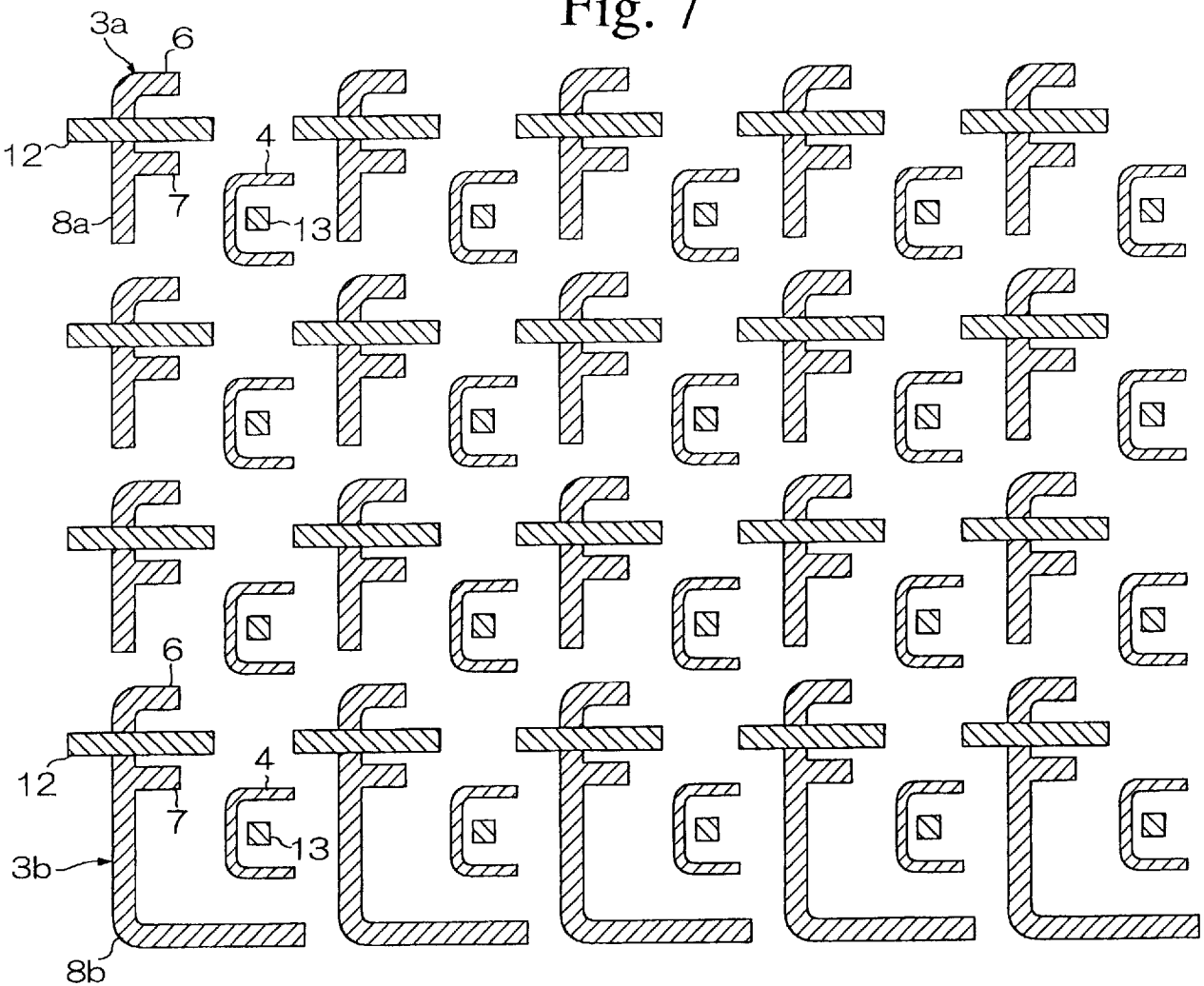
FIG. 7 is a cross sectional view (along the A—A line in FIG. 1), when male type connectors are connected to the female type connector with applied ground terminals shown in FIGS. 5 and 6.

These terminals 3*a,* 3*b* and 4 are arranged similarly to the first embodiment, in a zigzag manner, as shown in FIG. 7, such that the ground terminals 3*a* or 3*b* are disposed on the diagonal lines connecting signal terminals 4 which are arranged in the grid like pattern. The only difference from the first embodiment is that the ground terminals arranged at the lowermost level have sealed beams with L-like cross sections. The other remaining ground terminals 3*a* are provided with the plate-like sealed beams 8*a*.

Figure 5:
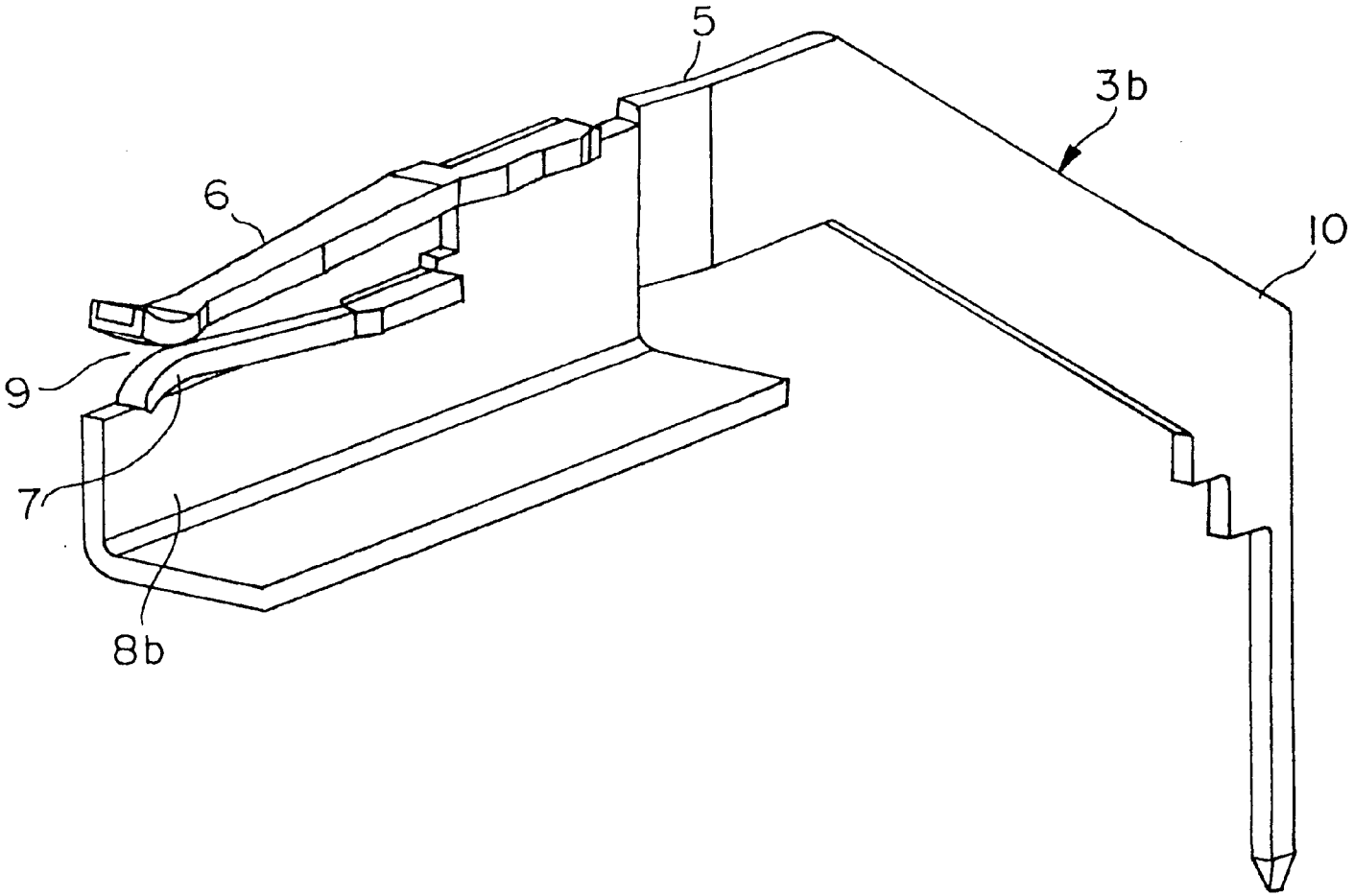
FIG. 5 is a diagram showing the ground terminal applied to a female type connector according to the second embodiment of the present invention, and a perspective view from the connecting point of the connector.
Figures 6A, 6B, 6C, 6D:
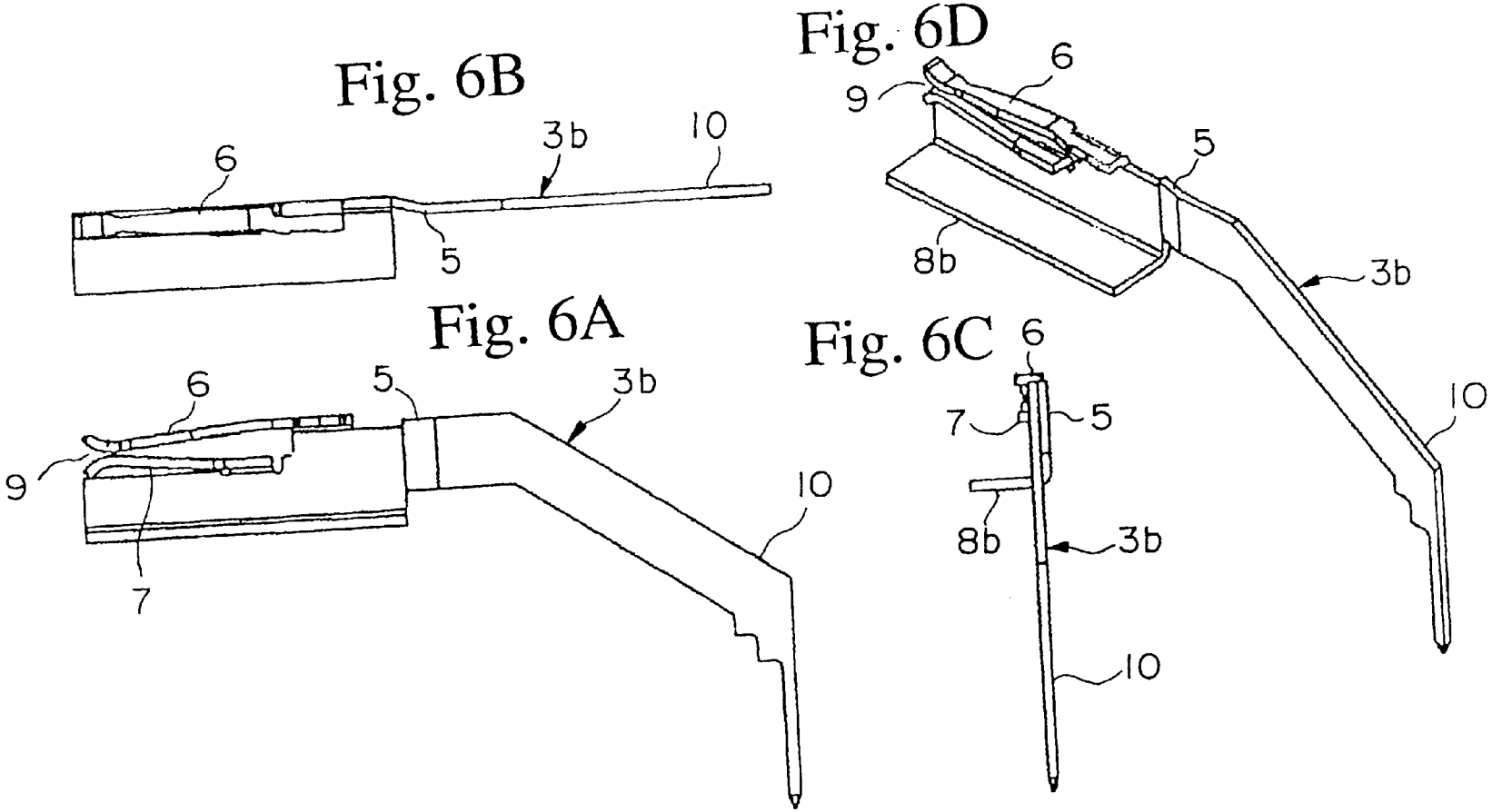
FIGS. 6A, 6B, 6C and 6D are diagrams showing the ground terminal applied to the connector shown in FIG. 5.

FIG. 5 is a perspective view showing the ground terminals 3*b* viewed from the connecting end of the connector, and FIG. 6A, 6B, 6C and 6D show the ground terminal 3*b,* and FIG. 6A is a front view, 6B a plan view, 6C is a back view from the connecting portion with the base, and 6D is a perspective view from the connecting portion with the base.

The sealed beam 8*b* provided for the ground terminal 3*b* arranged at the lowermost level has a bottom beam which is bent at a right angle and the signal terminals 4 are located at the inner side of the L-shaped sealed beam 8*b*. The tulip contact 9 is formed by both the main beam 6 extending from the contact proximal 5 toward the top and the sub-beam 7, the same as in the first embodiment. The female-type connector according to the present invention is capable of shielding not only the horizontal direction of the electromagnetic waves emitted by the signal terminals 4 by the sealed beam 8*a,* but also the vertical (downward) direction of the electromagnetic waves by the bent sealed beam 8*b*. Consequently, crosstalk generated between signal terminals can be effectively reduced and the transmission characteristics of the high frequency signal can be improved.

Furthermore, when the connector is connected, since the ground pins 12 of the male-type connector also contribute to the shielding of the electromagnetic waves, the transmission characteristics of the high frequency signal are improved drastically. Since the ground pins 12 also contribute to the shielding, it is possible to achieve better transmission characteristics without requiring enlargement of the sealed beam 8*b,* and thus, the size and shape of the sealed beam can be freely designed, which results in improving the freedom of designing the female type connector and also enable lightening of the connector.

It is to be understood that the present invention is not limited to the hereinabove described preferred embodiments, and modifications of the design of the ground terminals and the signal terminals are possible without departing from the concept of the present invention and are included in the present invention. Regarding the design of the ground terminals, it is important to provide a plate type or a L-type sealed beam, but the shape of the sealed beam can be modified appropriately depending upon the shape, size and the distances with the signal terminals, and the point is to design to enable the shielding of the electromagnetic waves. That is, if it is possible to shield the electromagnetic waves, any shapes can be adopted including a plate-type, L-shape, U-shape, or a shape bent into any angle.

As described hereinabove, it is possible for the connector according to the present invention to shield the electromagnetic waves between the signal terminals by providing the plate-like , L-shaped, and U-shaped sealed beam for preventing the problems such as crosstalk. In particular, when a very high frequency band signal is used, the effect in preventing crosstalk is remarkable and the signal transmission characteristics are drastically improved. That is, the connector of the present invention exhibits an excellent shielding effect in shielding the electromagnetic waves emitted from the signal terminals so as not to reach to the other signal terminals, since, when the connector is connected, the circumference of the signal terminals are surrounded by the ground terminals and the ground pins connected to the ground terminals.

According to the method of shielding the signal terminals by the present invention, the signal terminals are surrounded by both ground terminals and the ground pins, when the connector is connected, so that the electromagnetic waves from the signal terminals are well shielded. Since the sufficient shielding is finally obtained when the connector is connected, it is an advantageous effect of the present invention that the connector can be designed comparatively free

What is claimed is:

1. A connector comprising a plurality of signal terminals for transmitting signals and a plurality of ground terminals for grounding disposed so as to surround said signal transmitting terminals and both terminals are arranged in a zigzag manner, wherein the terminal for grounding comprises:

a plate-type sealed beam having a contact end for receiving a grounding pin;

a sub-beam that is a portion of said sealed beam that is displaced to be generally perpendicular to a plane of said sealed beam adjacent to the contact end and that extends in parallel to said sealed beam such that said sealed beam and said sub-beam do not interfere with each other;

a main beam that is a further portion of said sealed beam that is displaced to be generally perpendicular to the plane of said sealed beam adjacent to the contact end and that extends in parallel with said sealed beam and in the same direction as said sub-beam;

wherein the ground terminal is F-shaped when viewed from the contact end.

2. A connector according to claim 1, wherein said sealed beam is L-shaped.

3. A connector according to claim 1, wherein, when the connector is connected, the circumference of the signal terminal is surrounded by the ground terminals and ground pins of opposing parts such that electromagnetic waves emitted from the signal terminals are shielded.

4. A connector according to claim 3, wherein said ground terminal and said ground pin cross at an right angle.

5. A ground terminal for an electrical connector, the ground terminal comprising an elongated metal plate with an end having a generally planar part with a first side edge and two generally parallel second side edges that are each spaced a different distance from the first side edge, a first contact portion of the metal plate being bent at one of the second side edges to be generally perpendicular to a plane of the planar part, a second contact portion of the metal plate being bent at the other of the second side edges to be generally perpendicular to the plane of the planar part, the first and second contact portions being juxtaposed to receive a ground pin therebetween.

6. The ground terminal of claim 5, wherein the second contact portion is shorter than the first contact portion, a further edge of the planar part that connects the two second side edges defining a depth of the ground terminal.

* * * * *